US005544367A

United States Patent [19]

March, II

[11] Patent Number: 5,544,367

[45] Date of Patent: Aug. 13, 1996

[54] FLEXIBLE HELMET

[76] Inventor: Richard W. March, II, P.O. Box 264, Franklinton, N.C. 27525

[21] Appl. No.: 299,532

[22] Filed: Sep. 1, 1994

[51] Int. Cl.[6] ..... A42B 3/00

[52] U.S. Cl. ..... 2/410; 2/411

[58] Field of Search ..... 2/410, 6.1, 6.2, 2/6.3, 6.6, 411, 412, 414, 420, 425

[56] References Cited

U.S. PATENT DOCUMENTS

| | | | |
|---|---|---|---|
| 2,706,294 | 4/1955 | Sprinkle | 2/414 |
| 2,717,384 | 9/1955 | Frothingham | 2/414 |
| 3,784,984 | 1/1974 | Aileo | 2/3 R |
| 3,786,519 | 2/1974 | Aileo | 2/6 |
| 4,023,209 | 6/1977 | Frieder | 2/6 |
| 4,843,642 | 3/1989 | Brower | 2/6 |
| 5,173,970 | 12/1992 | Shifrin | 2/410 |

OTHER PUBLICATIONS

David Clark Co., MIL–H–81735(AS); advertising brochure, helmets HGU–24/P and HGU–25/P.

Gentex Corporation, part Nos. 83D6167–1 and 83D6167–2; advertising flyer.

*Primary Examiner*—Michael A. Neas

[57] ABSTRACT

An aerodynamically streamlined flexible protective helmet assembly comprising an outer layer of impact resistant segments (61–67) confined within fabric chambers overlying an inner layer of closely abutting impact resistant energy absorbing structures (71–77) confined within elastic fabric chambers and including an elliptically annular crown structure (78) confined within a fabric chamber.

12 Claims, 5 Drawing Sheets

FLEXIBLE HELMET

FIELD OF THE INVENTION

This invention relates generally to protective helmet assemblys and particularly to those helmets which incorporate structural means for responding to the shape and size of the wearers' head.

BACKGROUND OF THE INVENTION

The need for a significantly protective helmet of reduced bulk and very thin silhouette has existed for many years in several athletic or entertainment sports, and in some cases, military applications. The purposes creating this need and which such a helmet should provide are minimal weight with corresponding stability and maximum maneuverability or very low aerodynamic resistance depending on the helmets' intended use. Protection of the wearers' head from impacts however, remains a priority over this need. The prior art consistently demonstrates this priority being provided for by the use of substantially unitary rigid outer shells. These shells, normally lined with a variety of impact absorbing materials, must be constructed large enough to accommodate additional padding structures or lining assemblys primarily for the purpose of responding to the shape, and to a limited degree, the size of the wearers' head. The use Of such padding therefore, increases the overall bulk and corresponding weight of the helmet, adversely affecting its dimensional profiles, stability, and aerodynamic resistance.

The conflict between the priority of providing adequate protection of the wearers' head and the need for a helmet of very low aerodynamic resistance has been approached by the prior art only indirectly on a very limited basis. Attempts to provide a solution to this problem have incorporated the use of flexible or elastic fabric. Typical of this approach for example, is that shown in U.S. Pat. Nos. 3,784,984 (1974) to Aileo and 4,023,209 (1977) to Frieder, Jr. et al. In these patents a helmet liner is constructed of fabric mesh formed into pockets into which a series of energy absorbent pads are inserted. The use of elastic mesh in these helmets is intended to provide some degree of flexible response to the wearers' head shape and size. This ability however, is severely limited by the copious use of non-elastic reinforcing tapes at the margins of various panels restricting the elastic function of those panels. This contradiction appears in the above patents.

The most significant problem inherent in the prior art however, as exemplified in part by the aforementioned patents, is vulnerability to impacts at locations where various padding structures are approximately adjacent with intentional spacing. The problem also occurs at the margins and regions of integral earcup assemblys utilized for sound attenuation and communications in military applications. This weakness also occurs in a similar manner at indentations in a single unitary pad as shown in U.S. Pat. No. 4,843,642 (1989) to Brower. An increased degree of abutment of sections is claimed to occur at these indentations upon a radial impact to adjacent sections. Although the helmet dispenses with the use of an overlying outer shell, no feature is present to protect the wearers' head from impacts directly at the point of these indentations.

Recognizing these vulnerabilitys, the prior art teaches that provision for full impact protection must revert to the concept of the use of rigid substantially unitary outer shells or an assembly of parts substantially embracing this approach. Due to their inflexible nature these shells present an increased overall bulk in their silhouette with a corresponding increase in weight and diminished maneuverability. They do not present streamlined conformity to the wearers' head, but rather as objectionable encumbrances in that regard. The designs of the prior art, even with these shells installed, leave certain points and areas of the wearers' head vulnerable to direct impact and therefore do not provide complete protection. Also, in cases where these shells are removably installed as separable accessories, they may become dislodged during certain uses.

Additional drawbacks to the use of these shells include increased complexity and expense of manufacture, and inconvenience for the user who must inventory, transport, and assemble multiple components for full protection.

OBJECTIVES AND SUMMARY OF THE INVENTION

One object of the current invention is to provide a helmet which offers protection from the force of impacts at all points about the wearers' head equivalent to that of the outer shells of hard shell helmets and to the extent of commonly accepted and established standards for non-military use.

A further objective of the invention is to provide the above protection without the use of a unitary rigid outer shell structure or a static assembly of components substantially embracing that approach to impact protection.

A further objective of the invention is to provide a helmet with minimum bulk and weight which presents a compact, thin silhouette from all aspects resulting in maximum maneuverability and minimum aerodynamic resistance.

A further objective of the invention is to provide a protective helmet with the above qualities which exhibits maximum response and conformity to a wearers' head shape and size. The intention of this objective is to accomplish its purpose as a combination of the functional qualities of the design of the helmet and the materials used in its construction without reliance on additional manual adjustment of various components such as those which appear for example, in the previously mentioned patents.

A further objective of the invention is to provide a protective helmet which utilizes a minimum diversity of materials in its construction, which in conjunction with the below stated objective, results in simplicity and economy of manufacture.

An additional objective of the invention is to provide a protective helmet with all of the above qualities and advantages which are present in a single unitized assembly thereby affording the user the convenience of a minimum number of parts necessary to inventory, transport, store, and assemble for full protection.

The invention comprises a protective flexible helmet constructed from multiple layers of elastic and non-elastic fabric formed into an inner and an outer layer of interconnected chambers. Each of the chambers of the inner layer contains a relatively rigid impact resistant segment of material to which energy absorbent padding has been applied. These padded structures are held in close abutment to each other along their longitudinal margins by their confining chambers. These structures and their chambers are shaped in length such that they extend longitudinally from the crown area of the helmet to its lower margins. They are dimensioned in width such that in concert with each other they extend along the entire lateral circumference of the helmet body. Along their upper lateral margins these structures and chambers abut a single, common elliptically annular crown chamber and structure which forms the central crown area of the helmet. These structures and chambers, along with the crown chamber and structure, thereby form a contiguous inner helmet body.

Overlying the inner layer of chambers and structures is an outer layer of chambers each containing a relatively rigid impact resistant segment of material absent of padding. These segments and chambers are dimensioned in length such that they extend from abutment with the crown chamber and structure to the lower margins of the helmet body. They are dimensioned in width and shape such that they expose a narrow central longitudinal area of the outer surface of the inner layer of chambers and structures, and are thus positioned intermittently along the lateral circumference of the helmet body. They are also positioned such that their central longitudinal areas are adjacent to the longitudinal abutments of the inner layer of chambers and structures.

The above arrangement, and as further described in detail to follow, permits the construction of a helmet assembly which provides complete protection from impact over the entire surface of the wearers' head. Due to the overlapping arrangement of the outer segments relative to the inner padded structures there is no point on the helmet surface which does not present a structurally sound resistance to impact. The helmet therefore provides protection from impacts equivalent to rigid outer shells without their use.

In addition, the use of elastic fabric in construction of the inner layer of chambers and the spacing of the outer layer of chambers permits a wide range of flexibility in the helmet body. This range of flexibility is also uninhibited by the use of any additional binding or seaming materials. Commonly available elastic fabrics and conventional sewing techniques make the use of such materials unnecessary while permitting the construction of a very durable assembly.

This approach therefore provides a flexible helmet with superior responsiveness and conformity to the wearers' head shape and size while simultaneously providing complete protection from impacts. This concept of construction also permits a very compact assembly resulting in streamlined aerodynamic resistance and maximum maneuverability and stability. Important additional advantages are simplicity and economy of manufacture due in part to the limited diversity of materials necessary for construction.

It will therefore be apparent to one skilled in the art, here and in the detailed description to follow, together with the accompanying drawings, that this departure in concept relative to the prior art, accomplishes the objectives of the invention.

BRIEF DESCRIPTION OF THE DRAWINGS

In the drawings which are to be read in conjunction with the specification and the detailed description to follow.

As a further general guide to the drawings the below number series refer to:

11–17: seams joining lower lateral margins of inner and outer panels forming the inner layer of chambers

21–27: outer fabric panels of the inner layer of chambers

31–37: inner fabric panels of the inner layer of chambers

41–47: panels forming the outer layer of chambers

51–57: longitudinal seams joining adjacent inner layer chambers

61–67: impact resistant segments in the outer layer chambers

71–77: impact dissipating structures in the inner layer chambers

DETAILED DESCRIPTION OF THE INVENTION

In the following text the term longitudinal or a derivative is to be interpreted as referring generally to vertical and interchangeably to both the sagittal (anterior-posterior) and coronal (side-to-side) planes of the helmet. The term lateral or a derivative is to be interpreted as referring generally to horizontal and approximately perpendicular to longitudinal. Terms of orientation contemplate the helmet in use with the wearers' head in a substantially upright position. The term segment refers to a section of sheet-like material which has been molded or heat formed appropriately for its location as shown in the accompanying illustrations, relative to the generally hemispherical shape of the human head. The term structure refers to a segment to which energy absorbent padding has been laminated or cemented.

Figure 1:
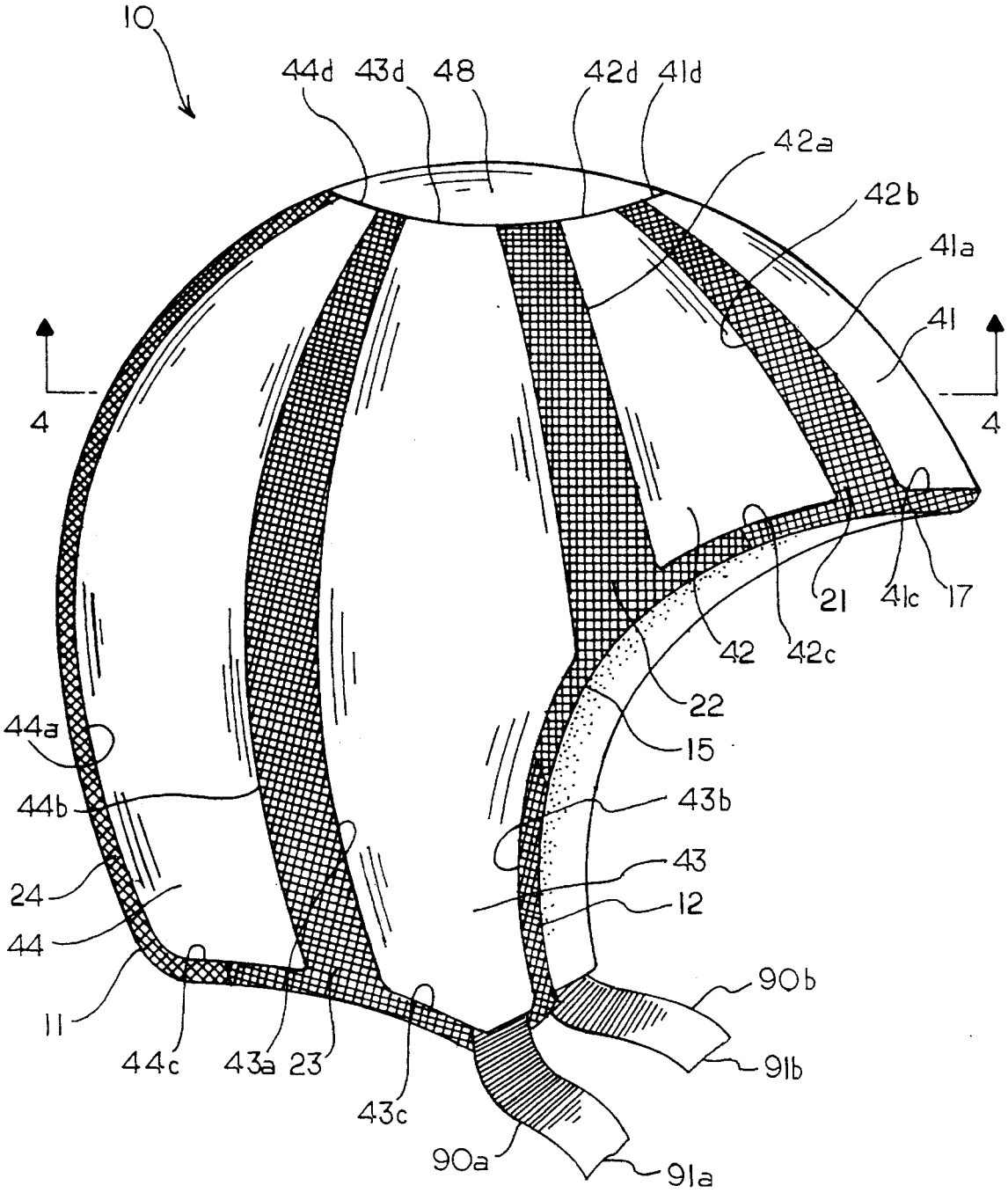
FIG. 1 is a side elevational view of the helmet from the wearers' right side.
Figure 3:
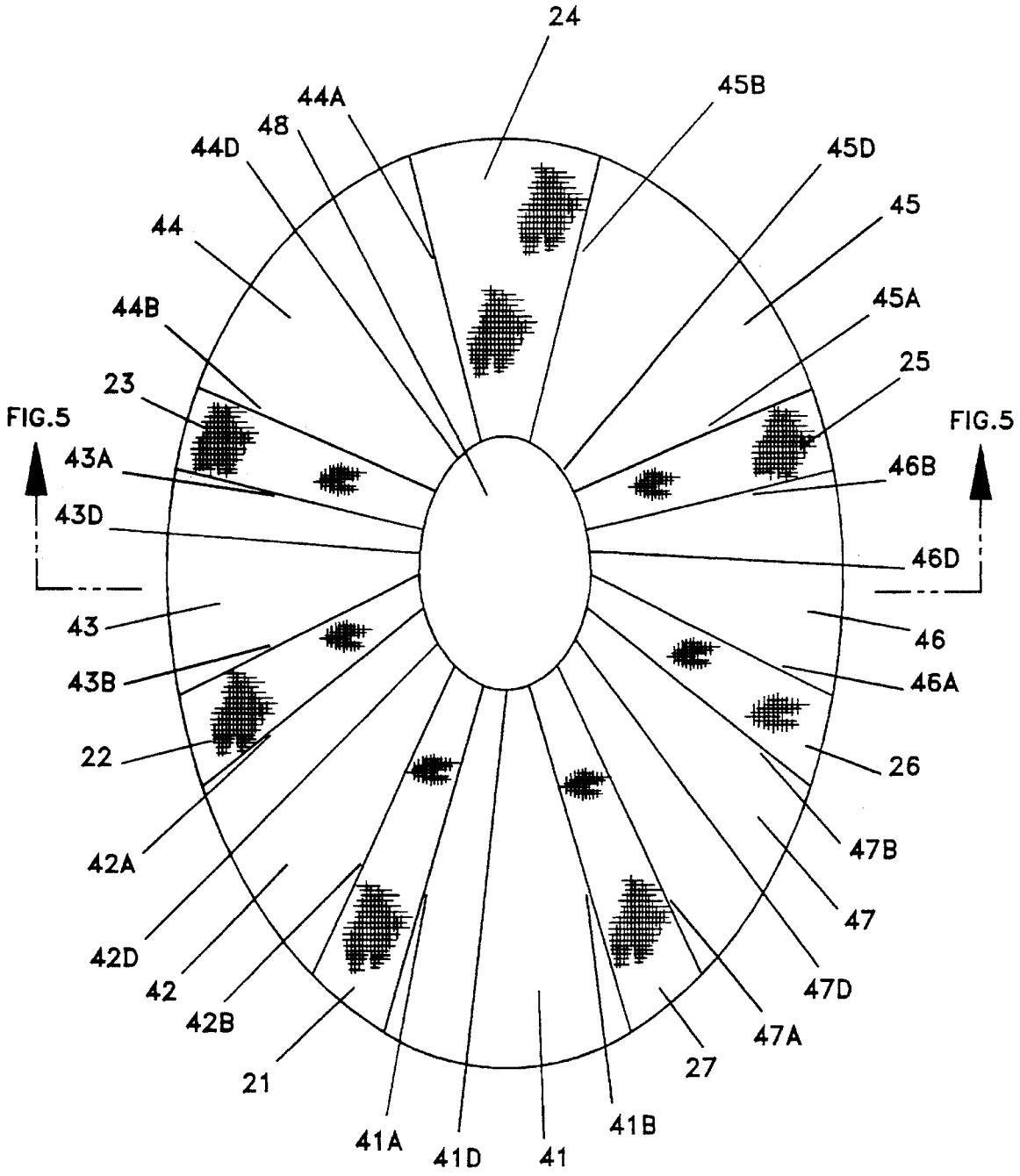
FIG. 3 is an outer plan view of the crown area of the helmet.
Figure 4:
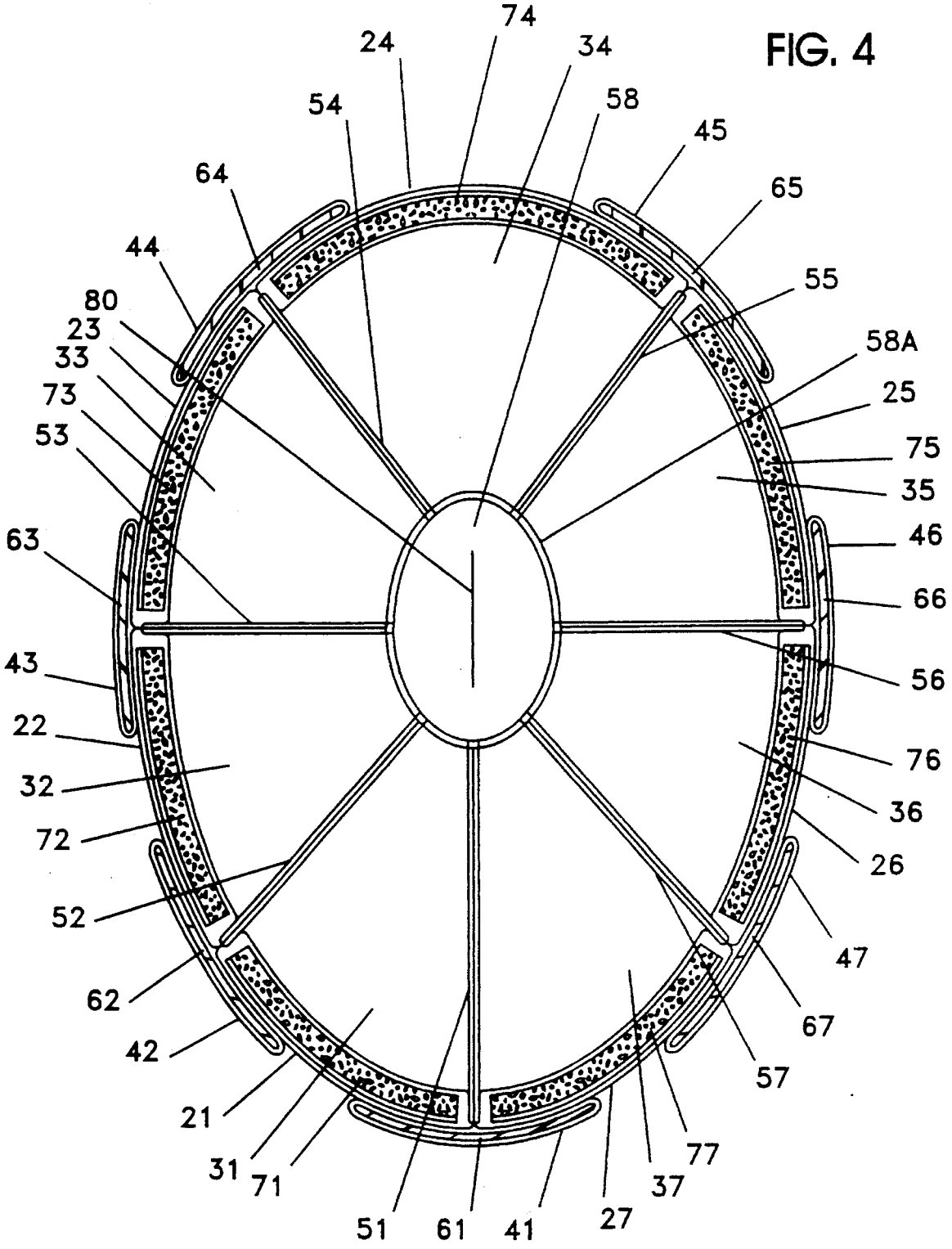
FIG. 4 is a fragmentary plan view of the interior of the helmet taken along line 4—4 of FIG. 1.
Figure 5:
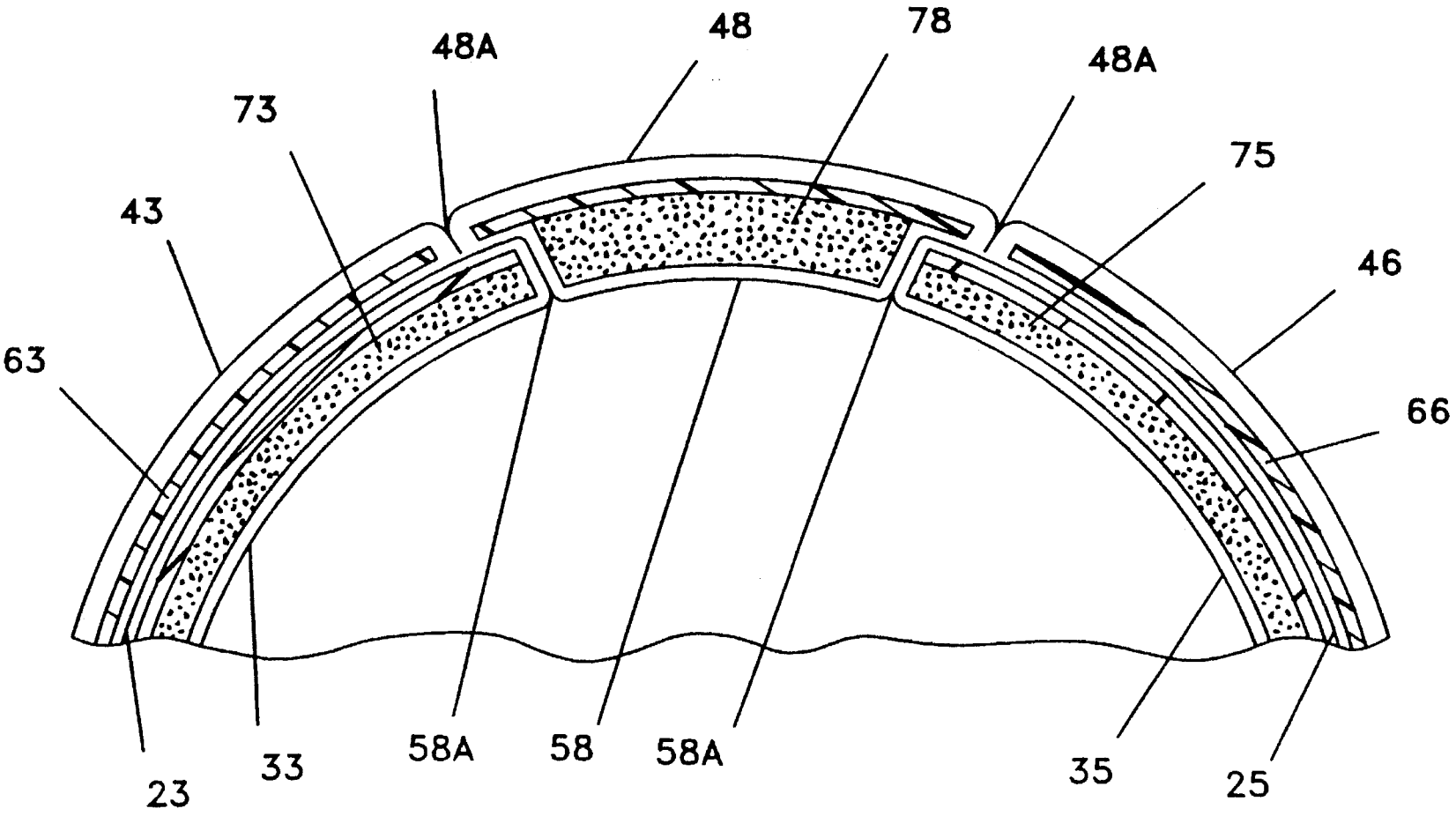
FIG. 5 is a fragmentary elevational view of the crown area of the helmet taken along line 5—5 of FIG. 3.

Referring now to FIG. 1 there is shown a protective flexible helmet generally represented as numeral 10 which comprises an inner layer of enclosed chambers containing structures and formed by attaching outer panels 21, 22, 23, 24, 25, 26, and 27 to corresponding inner panels 31, 32, 33, 34, 35, 36, and 37 as best shown in FIG. 4. Overlying the inner layer of chambers is an outer layer of enclosed chambers containing segments formed by attaching panels 41, 42, 43, 44, 45, 46, and 47 to the inner layer of chambers as shown in FIGS. 3 and 4. Panels 48 and 58 form an elliptically annular crown chamber containing structure 78 as best shown in FIG. 5. The helmet includes an adjustable chinstrap 90A and 90B as shown in FIG. 1, which incorporates conventional releaseable hardware (not shown) attached to its distal ends 91A and 91B as shown in FIG. 1.

The inner layer of chambers each confine within them a protective padded structure shown in FIG. 4 as numerals 71, 72, 73, 74, 75, 76, and 77. Each of these structures substantially conforms to the shape and fully occupies the interior of its corresponding chamber. These structures are each formed in part, of a relatively rigid impact resistant planar segment of material. While having an overall uniformity, these segments may vary in thickness or density depending on the degree of impact resistance desired in a particular embodiment of the invention. They may be formed from for example, a thermoplastic polymer or polycarbonate resin, or from a nylon or carbon fiber and resin composite, or from other suitable material, with a thickness of approximately 1.5 mm. Laminated or cemented to the inner surface of each of these segments is a layer of energy absorbent padding oriented such that in the completed assembly this padding will be adjacent to the interior of the helmet and the wearers' head. This padding, while having an overall uniformity, may also vary in thickness or density depending on the degree of energy absorbing ability desired in a particular embodiment of the invention. This padding however, preferably has a density of approximately 7 lbs/cu.ft. as defined by U.S. ASTM standards. The padding may be formed from for example, a crushable polystyrene material, or from expanded polyurethane or polypropylene foam, or from a nitrile polyvinylchloride sponge rubber, or from other suitable material, with a nominal thickness in the preferred embodiment of 12 mm. This padding may also consist of laminations of two or more of the above materials of differing densities.

As best shown in FIG. 3, panels 21, 22, 23, 24, 25, 26, and 27, and panels 31, 32, 33, 34, 35, 36, and 37 which form the inner layer of chambers, are formed from a closely woven, flexible, and elastic textile fabric. In the preferred embodiment of the helmet the yarns of this elastic fabric have a potential elongation of approximately 60%. These panels may also be formed from elastic fabric having a percentage of potential elongation which varies from the above depending on the degree of flexibility desired in alternate embodiments of the helmet. This elastic fabric is oriented such that its perpendicular yarns correspond generally to the longitudinal and lateral aspects of the helmet.

Figure 2:
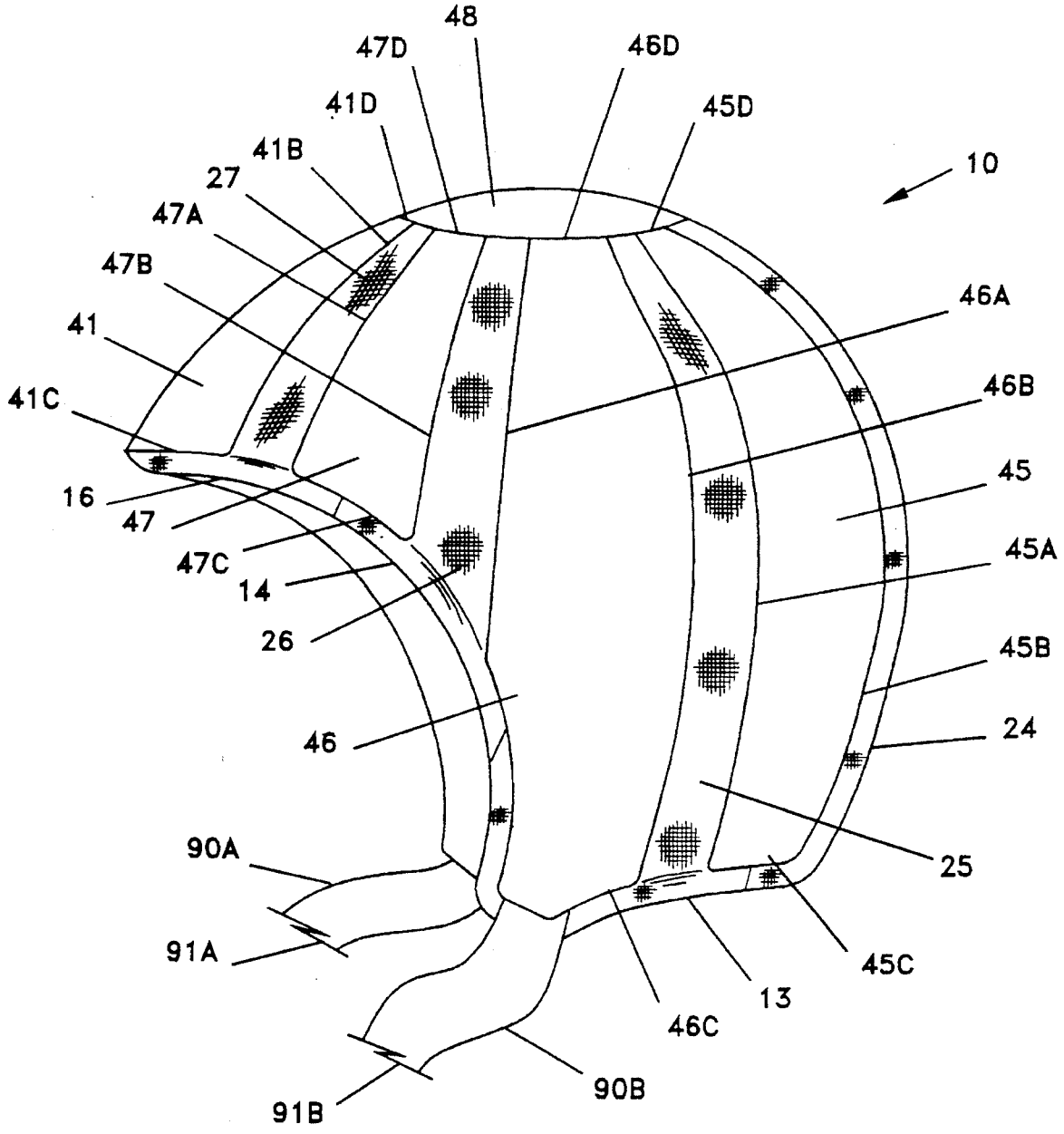
FIG. 2 is a side elevational view of the helmet from the wearers' left side.

In the preferred embodiment of the helmet 10 as best illustrated in FIG. 3, the inner layer of chambers restrict the structures confined within them to close abutment along their upper lateral margins to the perimeter of an elliptically annular crown chamber containing structure 78. These structures are also restricted by their chambers to close abutment with adjacent inner layer structures along their longitudinal margins. These chambers and structures are shaped and dimensioned such that they extend longitudinally from the crown chamber in an arcuate radial manner. Their lower lateral margins form the lower margins of the helmet body as best shown in FIGS. 1 and 2. They are also shaped and dimensioned in their lateral width such that in concert with each other they extend along the entire perimeter of the crown chamber and laterally along the entire circumference of the helmet. This arrangement of an inner layer of chambers and structures, along with the crown chamber and structure, thereby forms a contiguous helmet body.

The overlying outer layer of chambers, formed by attaching panels 41, 42, 43, 44, 45, 46, and 47 to the inner layer of chambers, each confines within them a relatively rigid impact resistant segment of material. These segments shown in FIG. 4 as numerals 61, 62, 63, 64, 65, 66, and 67 each substantially conforms to the shape and fully occupies the interior of its corresponding chamber. These segments are formed from a material similar to that used to form the segment components of the inner layer of padded structures. These outer chamber panels are formed of a closely woven and flexible but substantially inelastic textile fabric such as nylon or a blend of other suitable synthetic yarns. They may also be formed of leather or a lamination of a suitable fabric and leather, with leather as their outermost surface for cosmetic appearance. They may also be formed of elastic fabric similar to that used to form the inner layer of chambers depending on the degree of flexibility desired in the helmet.

The outer layer chambers and their corresponding segments are shaped and dimensioned such that they extend longitudinally from close abutment with the crown chamber to within approximately 5 mm of the lower margins of the helmet body. They are shaped and dimensioned such that they expose a central longitudinal area of each of the inner chambers as shown in FIGS. 1, 2, and 3. These longitudinal areas vary in width from approximately 15 mm at their upper regions nearest panel 48 to approximately 25 mm at their lower regions nearest the lower margins of the helmet body. These outer chamber panels are also positioned such that they restrict their corresponding segments to positions which locate the central longitudinal areas of these segments adjacent to and overlying the the longitudinal abutments of the inner layer of chambers and structures.

Panel 48 shown in FIG. 3 is formed from fabric, or a lamination of fabrics identical to that as described to form outer panels 41–47. Panel 58 shown in FIG. 4 is formed of fabric identical to that as described to form inner chamber panels 21–27 and 31–37. Together they form an elliptically annular crown chamber which confines within it structure 78. Structure 78 substantially conforms to the shape and dimensions of the interior of the crown chamber and is formed in a manner and of materials identical to those described to form inner layer structures 61–67. The impact resistant segment component of structure 78 and panel 48 are shaped and dimensioned such that they extend beyond and overly the upper lateral margins of the inner layer of chambers and structures by approximately 10 mm as shown in FIG. 5. The crown chamber is also positioned such that the greater planar dimension of its elliptically annular shape is substantially in alignment with the saggital longitudinal plane of the helmet. Formation of the crown chamber occurs as a result of specific stages in the assembly of the helmet as later described.

Conventional sewing methods are employed in construction throughout the helmet. The longitudinal margins and the lower lateral margins of panels 41, 42, 43, 44, 45, 46, and 47 are sewn to panels 21, 22, 23, 24, 25, 26, and 27 as shown in FIGS. 1 and 2. Panel 41 is sewn to panels 21 and 27 along 41A, 41B, and 41C. Panel 42 is sewn to panels 21 and 22 along 42A, 42B, and 42C. Panel 43 is sewn to panels 22 and 23 along 43A, 43B, and 43C. Panel 44 is sewn to panels 23 and 24 along 44A, 44B and 44C. Panel 45 is sewn to panels 24 and 25 along 45A, 45B, and 45C. Panel 46 is sewn to panels 25 and 26 along 46A, 46B, and 46C. Panel 47 is sewn to panels 26 and 27 along 47A, 47B, and 47C.

Sewing along 43C and 46C also incorporates chinstrap sections 90A and 90B which are inserted between panels 43 and 23 and panels 46 and 25 respectively, prior to sewing at 43C and 46C, thereby attaching the chinstrap sections to the helmet. It is contemplated in the preferred embodiment that the chinstrap will be comprised of a heavy, densely woven synthetic yarn such as nylon formed into a common strap-like material approximately 15 mm in width. The fabric comprising panels 43, 46, and crown chamber panel 48 provides a contiguous line of stress for the forces applied by the chinstrap when in use. The chinstrap thereby securely fastens the helmet in place on the wearers' head.

Panels 21, 22, 23, 24, 25, 26, and 27, and 31, 32, 33, 34, 35, 36, and 37 are attached by sewing along their lower lateral margins forming the lower lateral margins of the helmet body as shown in FIGS. 1 and 2. Panels 21 and 31 are sewn with seam 17 being formed; panels 22 and 32 are sewn with seam 15 being formed; panels 23 and 33 are sewn with seam 12 being formed; panels 24 and 34 are sewn with seam 11 being formed; panels 25 and 35 are sewn with seam 13 being formed; panels 26 and 36 are sewn with seam 14 being formed; and panels 27 and 37 are sewn with seam 16 being formed.

Inner chamber panels 21–27 and 31–37 are simultaneously sewn along their longitudinal margins, simultaneously attaching adjacent outer panels and adjacent inner panels to each other and their corresponding inner and outer panels. This sewing operation forms seams 51, 52, 53, 54, 55, 56, and 57 as shown in FIG. 4. These seams are formed from the lower lateral margins of the panels they attach to a point approximately midway from the perimeter of crown chamber panel 58 in a manner which directs the edges of these seams toward the interior of the helmet. Completion of the sewing of these seams to the perimeter of panel 58 occurs after insertion of the outer segments and inner structures in their respective chambers as later described.

Referring to FIG. 3, outer chamber panels 41–47 are sewn to the perimeter 48A of crown chamber panel 48 along their upper lateral margins at 41D, 42D, 43D, 44D, 45D, 46D, and 47D in a manner which directs the edges of the seams formed inwardly toward the helmet body. Inner chamber panels 21–27 and 31–37 are now sewn simultaneously along their upper lateral margins to the perimeter 58A of panel 58 as shown in FIG. 4, which also completes the formation of the crown chamber.

Segments 61, 62, 63, 64, 65, 66, and 67, and structures 71, 72, 73, 74, 75, 76, and 77 are now inserted in their respective chambers from the interior of the helmet through the incomplete lengths of seams 51–57, facilitated by the elastic property of the fabric used to form the inner chamber panels. After insertion of these segments and structures, formation and closing of the remainder of seams 51–57 to the perimeter 58A of crown chamber panel 58 is completed. Structure 78 is inserted in the crown chamber through a slit 80 provided in panel 58 as shown in FIG. 4. Slit 80 is then closed with a conventional sewing method.

It will be apparent to one skilled in the art of helmet design and construction that the invention accomplishes all of its objectives. The close abutment of the inner layer of structures by their confining chambers along with the alignment of the overlying outer segments with these abutments precludes there being any location on the wearers' head unprotected from impact by the helmet. This arrangement therefore renders the use of substantially unitary rigid outer shells unnecessary. The locations of the outer layer chamber panels and segments, exposing central longitudinal areas of the inner chambers and structures, in concert permits a wide range of flexibility laterally. Flexibility may also be enhanced by the use of impact resistant materials with a density permitting flexibility along the longitudinal aspects of the helmet.

Although there exists in the prior art a wide variety of protective helmets designed for various purposes, no example is available which addresses the problem as does the current invention. Nor does the prior art imply in any example or combination a potential embodiment which if reduced to practice, would offer an unintended but reasonably practical solution as described above. The current invention avoids entirely the approach of the prior art to full protection by providing a series of integral, internal overlapping segments and structures in a flexible assembly. The helmet thereby accomplishes its intended objectives among others, of providing full protection from impacts in an aerodynamically streamlined helmet. In addition to avoiding the encumbering protuberance of the prior art, the limited diversity of materials necessary, and simplicity of construction relative to the prior art, offers the benefits of economy and speed of manufacture. The unitary nature of the completed assembly also offers the benefits of simplified inventory, transportation, and storage, with field assembly of components unnecessary.

It is to be understood that details and terminology of the above description are not to be construed as limitations of the invention, but rather as an exemplification of the preferred embodiment. Without departing from the true scope of the claims, details, materials, and configuration are subject to change. Various embodiments of the invention may include for example, padded structures with openings having a variety of shapes to facilitate ventilation, exterior mounting of various accessory devices, application of absorbent fabric to the interior of the helmet, or alternate methods of attaching the chinstrap. Accordingly, the scope of the invention should be determined not by the embodiment illustrated and described, but by the appended claims and their legal equivalents.

Having described the invention, that which I claim is:

1. A flexible protective helmet assembly comprising an inner layer of a plurality of enclosed chambers formed from elastic textile fabric, the inner layer chambers each confining within them a discreet impact resistant and energy absorbing structure and forming the lower margins of the helmet, an integral fixedly attached overlying outer layer of a plurality of enclosed chambers formed from materials selected from the group consisting of flexible textile fabric and elastic textile fabric and leather, the outer layer chambers each confining within them a discreet impact resistant segment of material, a crown area, and means for attaching the inner layer chambers to adjacent inner layer chambers and attaching the outer layer chambers to the inner layer chambers whereby the wearer is provided protection from impacts substantially equivalent to that provided by protective helmets employing and comprising in part, substantially unitary relatively rigid outer shells.

2. An assembly as in claim 1 wherein each said structure substantially conforms to the interior shape and dimensions of its corresponding confining inner layer chamber, said segments each substantially conforms to the interior shape and dimensions of its corresponding outer layer chamber, the inner layer chambers and structures extend longitudinally in an arcuate radial manner from the crown area of the helmet to the lower margins of said helmet, and the outer layer of chambers and segments extend in an arcuate radial manner from the crown area of the helmet to the lower margins of said helmet.

3. An assembly as in claim 1 wherein the inner layer chambers are attached to adjacent inner layer chambers along their longitudinal margins, and the outer layer chambers are attached to the inner layer chambers along the longitudinal margins of the outer layer chambers.

4. An assembly as in claim 1 wherein the central longitudinal aspects of the outer layer chambers and segments are substantially in alignment with and adjacent longitudinal attachments of the inner layer chambers, and longitudinal margins of the outer layer chambers and segments overly the longitudinal margins of the inner layer chambers by predetermined dimensions.

5. An assembly as in claim 1 wherein central aspects of the outer surfaces of the inner layer chambers are exposed between longitudinal margins of the outer layer chambers.

6. An assembly as in claim 1 further including an elliptically annular crown chamber formed from material selected from the group consisting of flexible textile fabric and elastic textile fabric and leather, said crown chamber confines within it a discreet impact resistant and energy absorbing structure, and means are included for attaching said crown chamber to the inner layer of chambers and attaching said crown chamber to the outer layer of chambers.

7. An assembly as in claim 6 wherein said structure confined in said crown chamber substantially conforms to the interior shape and dimensions of said crown chamber, and the greater planar dimensions of said crown chamber and said structure are substantially in alignment with the sagittal longitudinal plane of the helmet.

8. An assembly as in claim 6 wherein said crown chamber is attached along its perimeter to upper lateral margins of said inner layer of chambers and to upper lateral margins of said outer layer of chambers of the helmet.

9. An assembly as in claim 6 wherein the the outer surface material of said crown chamber and the structure confined within the crown chamber overlies the upper lateral margins of said inner layer of chambers and the structures confined within them a predetermined dimension.

10. An assembly as in claim 6 wherein said means for attaching said crown chamber includes stitching.

11. An assembly as in claim 1 wherein said means for attaching includes stitching.

12. An assembly as in claim 1 further including a releasably securable adjustable chinstrap, and means for attaching said chinstrap to said helmet, said means for attaching said chin strap including stitching.

* * * * *